US006722862B2

(12) United States Patent
Hartnagel et al.

(10) Patent No.: US 6,722,862 B2
(45) Date of Patent: Apr. 20, 2004

(54) METERING PUMP WITH COMBINED INLET/OUTLET VALVE ELEMENT

(75) Inventors: Rolf Hartnagel, Esslingen (DE); Sascha Tippl, Denkendorf (DE); Liane Schupp, Esslingen (DE)

(73) Assignee: J. Eberspacher GmbH & Co. KG, Esslingen (DE)

( * ) Notice: Subject to any disclaimer, the term of this patent is extended or adjusted under 35 U.S.C. 154(b) by 0 days.

(21) Appl. No.: 10/083,780

(22) Filed: Feb. 24, 2002

(65) Prior Publication Data

US 2002/0155011 A1 Oct. 24, 2002

(30) Foreign Application Priority Data

Mar. 1, 2001 (DE) ..... 101 09 948

(51) Int. Cl.[7] ..... F04B 17/04; F04B 39/08
(52) U.S. Cl. ..... 417/417; 417/416; 417/505
(58) Field of Search ..... 417/415, 416, 417/417, 505

(56) References Cited

U.S. PATENT DOCUMENTS

| | | | | | |
|---|---|---|---|---|---|
| 1,998,338 A | * | 4/1935 | Spohrer | ..... | 137/565.18 |
| 3,781,140 A | * | 12/1973 | Gladden | ..... | 417/326 |
| 3,989,021 A | | 11/1976 | Kobayashi et al. | ... | 123/139 AZ |
| 5,085,563 A | * | 2/1992 | Collins et al. | ..... | 417/417 |
| 5,509,792 A | * | 4/1996 | Sullivan et al. | ..... | 417/417 |
| 5,572,922 A | * | 11/1996 | Moon | ..... | 92/181 P |
| 6,152,113 A | * | 11/2000 | Yi | ..... | 123/499 |

FOREIGN PATENT DOCUMENTS

| | | | | |
|---|---|---|---|---|
| DE | 821 761 | | 7/1949 | |
| DE | 1 653 386 | * | 9/1967 | ..... F04B/17/04 |
| DE | 1 653 386 | | 8/1971 | ..... F04B/17/04 |
| DE | 299 09 340 U1 | | 9/1999 | ..... F04B/53/10 |
| WO | WO 00/39460 | * | 7/2000 | ..... F04B/17/04 |

* cited by examiner

*Primary Examiner*—Justine R. Yu
*Assistant Examiner*—Timothy P. Solak

(57) ABSTRACT

A metering device for a heating appliance has a pump arrangement for the delivery of liquid that is supplied via an inlet region to an outlet region and a valve arrangement by which the pump arrangement is connected with the inlet region to receive liquid or with the outlet device to deliver liquid. The valve arrangement has a valve member that is brought into a first actuating position in which the valve member permits a liquid flow from the inlet region to the pump arrangement and prevents a liquid delivery from the pump arrangement to the outlet region. In a second actuating position the valve member prevents a liquid supply from the inlet region to the pump arrangement and permits a liquid delivery from the pump arrangement to the outlet region.

20 Claims, 10 Drawing Sheets

L
74
18
66
14
84
52
34
48
12
30
28
80
26
22
46
78
58
50
60
24
36
38
54
44
40
56
82
68
88
42
62
86
16
10
76
20

66
52
80
64
36
60
38
62
40
82
10

66
52
70
10
30
80
28
82

28
70
68
10
20
44
62
80
60
38
82
40
42
76

74a
18a
66a
14a
34a
52a
84a
12a
30a
48a
26a
80a
28a
78a
46a
58a
64a
22a
24a
38a
50a
54a
90a
36a
44a
56a
40a
62a
82a
68a
86a
16a
10a
76a
20a 28a
30a
26a
64a
92a
58a
90a
50a
38a
36a
82a
68a
10a 74b
18b
66b
14b
34b
52b
84b
30b
12b
48b
80b
28b
26b
22b
64b
46b
100b
24b
58b
102b
54b
50b
38b
36b
56b
40b
62b
82b
68b
16b
88b
86b
10b
20b
76b 18b
14b
66b
52b
24b
50b
100b
102b
82b
68b
16b
10b
20b 66b
28b
70b
102b
38b
68b
20b
80b
52b
100b
82b 66b
34b
26b
100b
58b
38b
62b
68b
20b
80b
28b
70b
102b
40b
82b

METERING PUMP WITH COMBINED INLET/OUTLET VALVE ELEMENT

STATEMENT REGARDING FEDERALLY SPONSORED RESEARCH OR DEVELOPMENT

Not applicable.

BACKGROUND OF THE INVENTION

The present invention relates to a metering pump device, particularly for a heating appliance, comprising a pump arrangement for the delivery to an outlet region of liquid which can be supplied through an inlet region, and also a valve arrangement by means of which the pump arrangement can be selectively connected to the inlet region to receive liquid, or connected to the outlet region to deliver liquid.

TECHNICAL FIELD

From German Patent Document DE 198 60 573 A1 a metering pump device is known in which a pump piston acting as a pumping member and also two respective valve sliders forming valve elements are displaceable by a magnet coil against the force of respective prestressing springs. In order to attain the required synchronization of movement of the different components which can be displaced by the single magnet coil in order to carry out inlet or outlet working cycles, their inertial masses and the prestress forces of the respectively allocated prestressing springs have to be exactly matched to each other. This necessitates compromises in the design of different components, or requires a comparatively complicated structure, with the consequence that the exact matching of the different courses of motion to each other can become lost under the influence of external circumstances, such as e.g. the temperature of the overall system, and thus this metering pump device cannot operate in a satisfactory manner.

From European Patent Document EP 0 930 434 A2 a metering pump device is known in which both a pump piston and also a valve slider of a relief valve can be moved by a single magnet coil. Further valve sliders or valve elements are present which are displaceable between a shutoff position and a release position according to the liquid pressure, for changing over between receiving or delivery working cycles. Here also it is necessary for the different system components, or also the forces provided by prestressing springs, to correspond exactly to the existing liquid supply pressure in order to attain a correct manner of operation.

SUMMARY OF THE INVENTION

The present invention has as its object to provide a metering pump device that with a comparatively simple structure ensures reliable functioning.

According to the invention, this object is attained by a metering pump device, particularly for a heating appliance, comprising a pump arrangement for the delivery of liquid which can be supplied via an inlet region to an outlet region, and also a valve arrangement by means of which the pump arrangement can selectively be brought into connection with the inlet region to receive liquid, or be brought into connection with the outlet region for the delivery of liquid.

It is further provided that the valve arrangement comprises a valve member which can be brought into a first actuating position and into a second actuating position, where in the first actuating position the valve member permits a liquid supply from the inlet region to the pump arrangement and prevents a liquid delivery from the pump arrangement to the outlet region, and in the second actuating position the valve member prevents a liquid supply from the inlet region to the pump arrangement and permits a liquid delivery from the pump arrangement to the outlet region.

The metering pump device according to the invention is thus basically divided into two mutually independent system regions, namely first, the pump arrangement by means of which liquid can be received from an inlet region and delivered to an outlet region, and also the valve arrangement which selectively brings the pump arrangement into connection with the inlet region or the outlet region for liquid exchange. These two system regions can be operated independently of each other and of course are consistent with each other in their different displacement or actuating movements without however requiring a positive mechanical coupling. This simplifies the structure of the metering pump device according to the invention in comparison with the devices known from the prior art.

For example, according to the present invention it can be provided that the pump arrangement comprises a piston displaceable in a pump chamber, and that the pump chamber can be selectively brought by the valve arrangement into connection with the inlet region or the outlet region.

The valve member is displaceable between the first actuating position and the second actuating position and can, for example, be constituted such that for the production of fluid exchange connections it has a channel region by means of which the pump arrangement can be brought into liquid exchange connection with the inlet region and/or the outlet region. It can furthermore be provided that the valve member is displaceable between the first actuating position and the second actuating position.

In an embodiment which is simple to construct and which operates reliably, it can be provided that the valve member is translatable for displacement between the first actuating position and the second actuating position. Alternatively or additionally to this translational movement of the valve member, the changeover between different actuating positions can also be attained in that the valve member is rotatable for displacement between the first actuating position and the second actuating position.

According to an aspect, the metering pump device according to the invention is characterized by a first actuating force producing arrangement for the production of a valve actuating force for the valve member and also a second actuating force producing arrangement for the production of a pump actuating force for the pump arrangement substantially independently of the production of the valve actuating force. A positive motion coupling of the different system regions, pump arrangement and valve arrangement, is thus not provided, with the consequence that the different system regions can be controlled, even in conformity with different operating states, for example flow speeds, affected by viscosity, of the liquid to be delivered.

It can, for example, be provided that the first actuating force producing arrangement and/or the second actuating force producing arrangement are constituted for the production of a magnetic force interaction.

An embodiment that uses the available constructional space can be attained in that the pump piston is displaceable in a piston displacement direction in the pump chamber and that the valve member is arranged in the pump arrangement in the piston displacement direction.

In order to be able to attain a quasi-continuous liquid delivery from the metering pump device according to the invention, a liquid reservoir can be provided in the flow region between the pump arrangement and an outlet aperture of the outlet region. The outlet aperture of the outlet region can then be closed by the valve member, or by a closure member motion-coupled to it.

According to a further aspect, the present invention provides for a valve arrangement which can be used in an application in connection with a metering pump device according to the invention. In this valve arrangement, a valve member is provided which can be brought by rotary motion into plural actuating positions. The rotation of a valve member for changing over between different actuating positions leads to a comparatively small constructional size of a valve arrangement, since no constructional space has to be kept in readiness for an element which is to be displaced linearly.

For example, it can be provided that an armature element is securely coupled to rotate with the valve member, and that the armature element is arranged for magnetic force interaction with pole elements of a magnet coil arrangement. In order to keep the construction and also the drive cost as low as possible, it is proposed that the valve member is prestressed into one of the actuating positions by a prestressing arrangement, preferably a torsion spring.

It can furthermore be provided that a channel arrangement is provided in the valve member, a first channel end region of the channel arrangement being connected to a first valve opening, and a second channel end region of the channel arrangement being able to be brought selectively, by rotation of the valve member, into connection with a second valve opening or a third valve opening.

BRIEF DESCRIPTION OF THE DRAWINGS

The present invention is described in detail hereinafter with reference to the accompanying drawings.

DETAILED DESCRIPTION OF THE INVENTION

Figure 1:
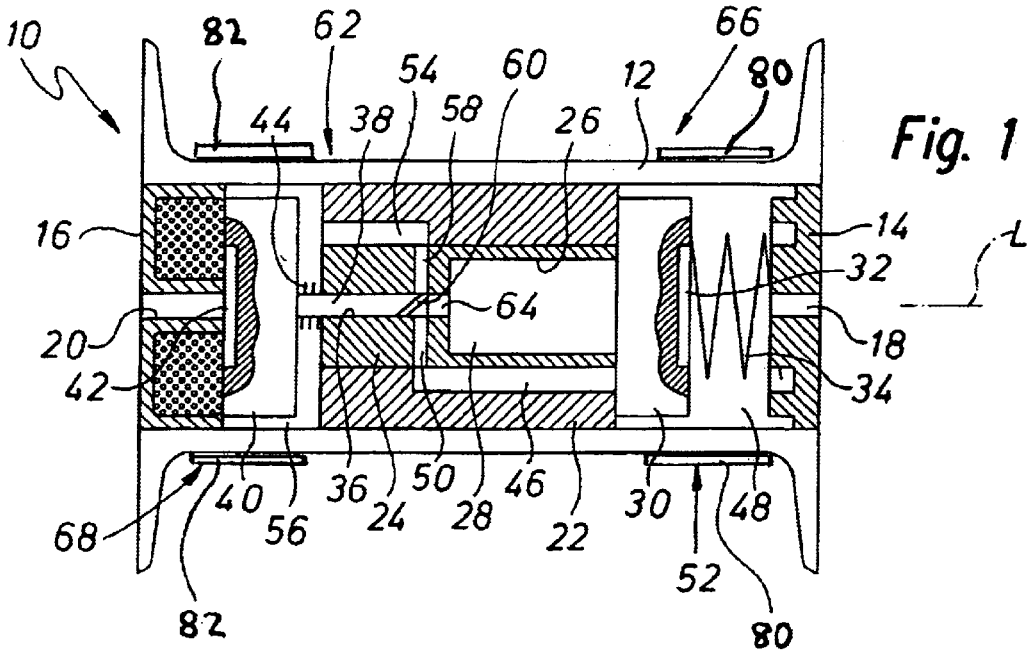
FIG. 1 shows a principle diagram in longitudinal section of a metering pump device according to the invention in a basic position.
Figure 2:
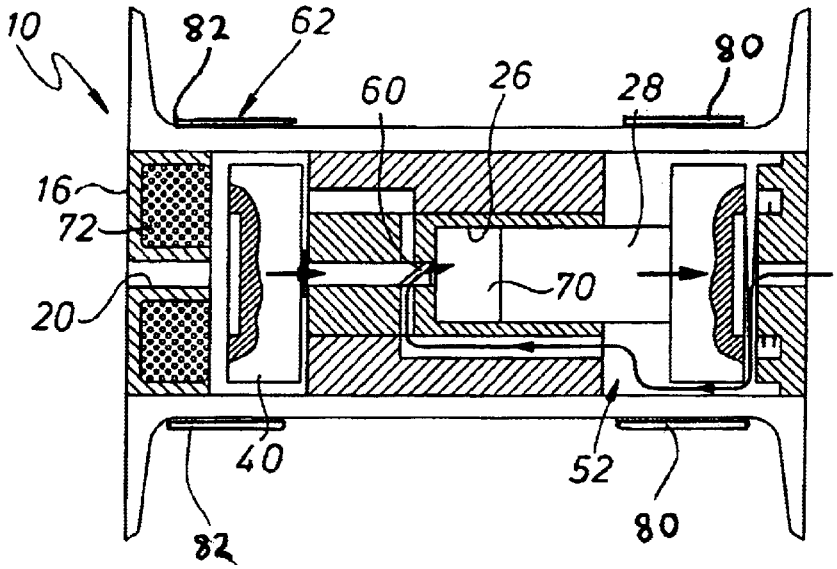
FIG. 2 shows the metering pump device shown in FIG. 1, in a liquid receiving state.
Figure 3:
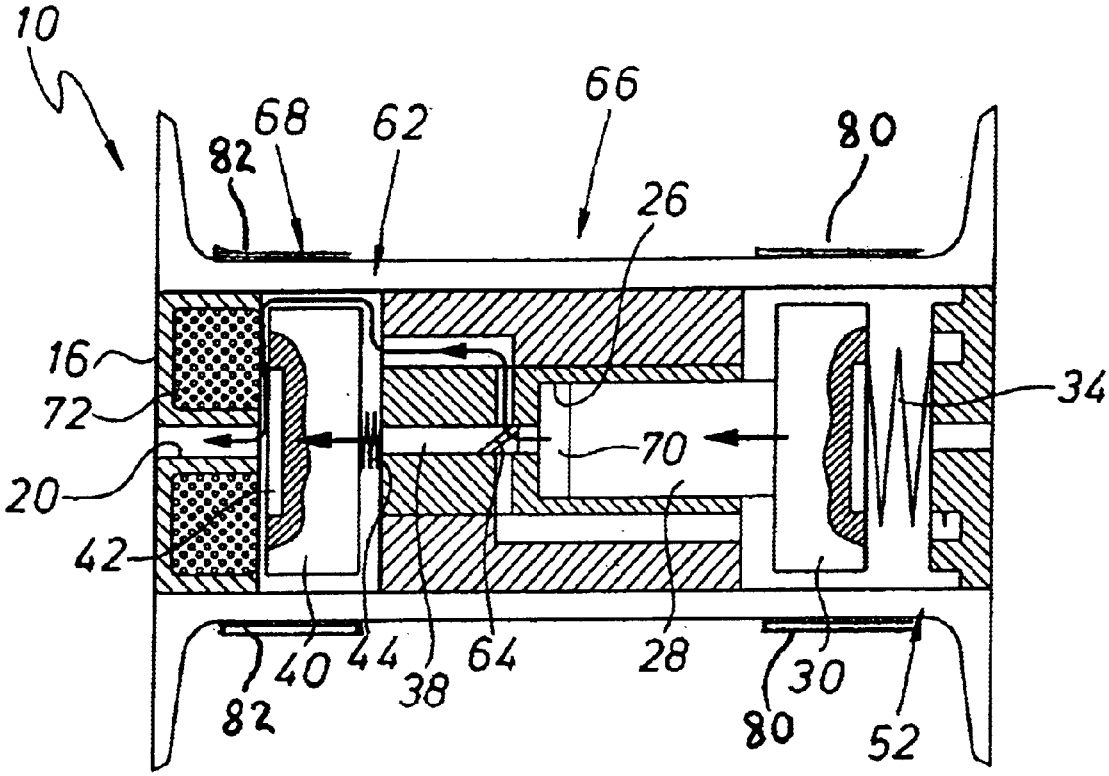
FIG. 3 shows the metering pump device shown in FIG. 1, in a liquid delivery state.

A metering pump device according to the invention is shown in principle in FIGS. 1–3 in various working cycles. It can be seen from FIG. 1 that the metering pump device 10 has an about cylindrical pump housing generally denoted by 12. Respective end pieces 14, 16 are inserted into this housing 12 in its two end regions. The end piece 14 has an inlet opening 18, while the end piece 16 has an inlet outlet opening 20. Furthermore an insert member 22 is arranged in the central region of the housing 12, and a further pump/valve insert denoted by 24 is arranged in this insert member 22. A substantially cylindrical pump aperture 26 is formed in the pump/valve insert 24, and a pump piston 28 is displaceably received in it. A pump armature 30 of magentizable material is secured to the pump piston 38. The pump armature 30 carries an elastic stop element 32 at its end region remote from the pump piston 28. Furthermore, a prestressing spring 34 engages this end region of the pump armature 30, and is supported at its other end on the end piece 14.

A valve aperture 36 to the pump aperture 26 is furthermore arranged in the pump/valve insert 24, and also substantially concentric of a longitudinal midline L of the metering pump device 10. The valve aperture 36 has a smaller internal diameter than the pump aperture 26 and opens into this. A valve slider 38 is received, displaceably in the direction of the longitudinal midline L, in the valve aperture 36. A valve armature 40 is secured to the valve slider 38. The valve 40 carries a sealing element 42 at its end region remote from the valve slider 38, and a prestressing spring 44 acts between the valve armature 40 and the pump/valve insert 24 so that, in the basic position shown in FIG. 1 of the valve armature 40, it has its sealing element 42 seated on the end piece 16 and thus liquid-tightly closes the outlet aperture 20.

At least one channel-like aperture 46 is provided in the insert member 22 and/or in the pump/valve insert 24, and leads from a space region 48 bounded on one side by the end piece 14 to an aperture 50 which extends substantially radially. The aperture 50 is open in its radially internal end region to the valve aperture 36 in the pump/valve insert 24. This aperture 50, together with the channel 46, the space region 48, and the inlet aperture 18, substantially forms an inlet region 52 of the metering pump device 10 according to the invention.

Furthermore, a further channel-like aperture 54 is provided in the insert member 22 and/or the pump/valve insert 24, and leads from the space region 56, bounded on one side by the end piece 16, to an aperture 58 which extends substantially radially. This aperture 58 opens, for example situated opposite the aperture 50, into the valve aperture 36.

It can be seen that the valve slider 38 has, in its axially free end region, at least one connecting groove 60, situated on its outer surface and placed obliquely with respect to the longitudinal midline L. In its end region near the axial end of the valve slider 38, this connecting groove 60 is open both to the axial end face of the valve slider 38 and also to the outer periphery of the same. In the basic state shown in FIG. 1, in which the valve slider 38 is moved away from the pump piston 28 to the maximum possible extent by means of the prestressing spring 44, there thereby results a fluid connection between the outlet region 62 substantially comprising the aperture 58, the aperture 54, the space region 56, and the outlet aperture 20, to an end region 64, directly adjoining the pump aperture 26, of the valve aperture 36 and thus also to the pump aperture 26.

It should be mentioned that both the pump arrangement 66, substantially comprising the pump piston 28 and the pump armature 30, and also the valve arrangement 68 substantially comprising the valve slider 38 and the valve armature 40, there is respectively allocated a magnetic coil 80, 82 shown in FIGS. 1–3, which magnetic coil is arranged, for example surrounding the housing 12 and which of course has or forms corresponding magnetic poles, so that on excitation of a respective coil, the armature 30 or the valve armature 40 can be displaced against the prestressing forces produced by the prestressing springs 34 or 44, and can be brought into the actuating positions also described and visible in FIGS. 2 and 3.

These two magnetic coils, not shown in FIGS. 1–3, can be driven independently of each other by a corresponding drive device, "independently" meaning here that no positive mechanical coupling is present between any of the components of the pump arrangement 66 and of the valve arrangement 68. The two magnetic coils can of course be driven so that a given phase coupling of the pump arrangement 66 and the valve arrangement 68 can be produced, in order to attain a mutually coordinated operation of these two system regions.

The operation of the metering pump device 10 according to the invention, shown in principle in FIGS. 1–3, is described hereinbelow with reference to these Figures.

In the basic state shown in FIG. 1, the inlet region 52 is blocked by the valve slider 38 with respect to the pump aperture 26, i.e., no liquid can flow into the pump chamber 26 through the inlet region 52. The outlet aperture 20 is closed by the valve armature 40 or by the sealing element 42 provided thereon. In this state, both magnetic coils (not shown in FIGS. 1–3) are not excited.

A state is now shown in FIG. 2 in which, by the excitation of both magnetic coils, both the pump armature 30 together with the pump piston 28, and also the valve armature 40 together with the valve slider 38, are displaced to the right in the drawing, against the respective prestressing force. In this state, as shown by the arrowed line, the inlet region 52 is now in fluid exchange connection via the connecting groove 60 with the pump aperture 26 or with a pump chamber 70 now formed by the displacement of the pump piston 28. By the displacement of the valve armature 40, the outlet aperture 20 is also released, so that liquid still arising from a previous delivery cycle and stored in a sponge-like intermediate storage element 72, which is arranged in the end piece 16 and is thus positioned in the outlet region 62, can flow out via the outlet aperture 20 and be supplied, for example, to a heater. In the state shown in FIG. 2, the pump chamber 70 is thus filled with liquid to be transported, and from the outlet region 62, the liquid stored therein is discharged.

In the delivery phase which can be seen in FIG. 3, the excitation of the magnetic coils is ended, so that due to the prestressing springs 34, 44, the pump piston 30 and the valve piston 40 are displaced to the left again, so that the pump chamber 70 is now in connection with the outlet region 62 through the connecting groove 60, and the pump piston 28 is moved into the pump aperture 26 and thus pushes the liquid contained in the pump chamber 70 toward the outlet region 62. In this phase, at first a flow path for the liquid driven out of the pump chamber 70 is still present between the pump armature 40 and the end piece 16 or the sponge-like intermediate storage element 72 contained therein, as indicated by the arrowed line. Already before the pump piston 28 has driven out from the pump chamber 70 all the liquid present in the latter, the sealing element 42 will however be seated on the end piece 16 and will thus prevent the further delivery of liquid through the outlet aperture 20. The liquid then still driven by the pump piston 28 out of the pump chamber 70 is delivered further due to the prevailing pressure and is received in the sponge-like intermediate storage element 72, so that it can flow out of the outlet aperture 20 in a next working cycle, in which the valve piston 40 lifts again from the end piece 16. At the end of this delivery cycle shown in FIG. 3, the metering pump device 10 will again assume the operating position shown in FIG. 1, in which both armatures, i.e., the pump armature 30 and the valve armature 40, together with the pump piston 28 or the valve slider 38, are moved by spring action into respective end positions, in which on the one hand the volume of the pump chamber 70 is minimized, and on the other hand the valve slider 38 is in a position in which the inlet region 52 is not in liquid exchange connection with the pump chamber 70 or the pump arrangement 66.

By means of the embodiment according to the invention shown in FIGS. 1–3 of a metering pump device 10, it becomes possible to allow the two system regions, namely the pump arrangement 66 on the one hand and the valve arrangement 68 on the other hand, to operate in a mutually mechanically uncoupled manner, so that each region can be configured optimally for its operation. The synchronization of movement takes place by corresponding driving of the magnetic coils allocated to these two regions.

A constructional arrangement of a metering pump device according to the invention, as has been described in principle hereinabove with reference to FIGS. 1–3, is shown in FIGS. 4–7. In these Figures, the same reference numerals denote components that correspond in construction or function to components of FIGS. 1–3.

Figure 4:
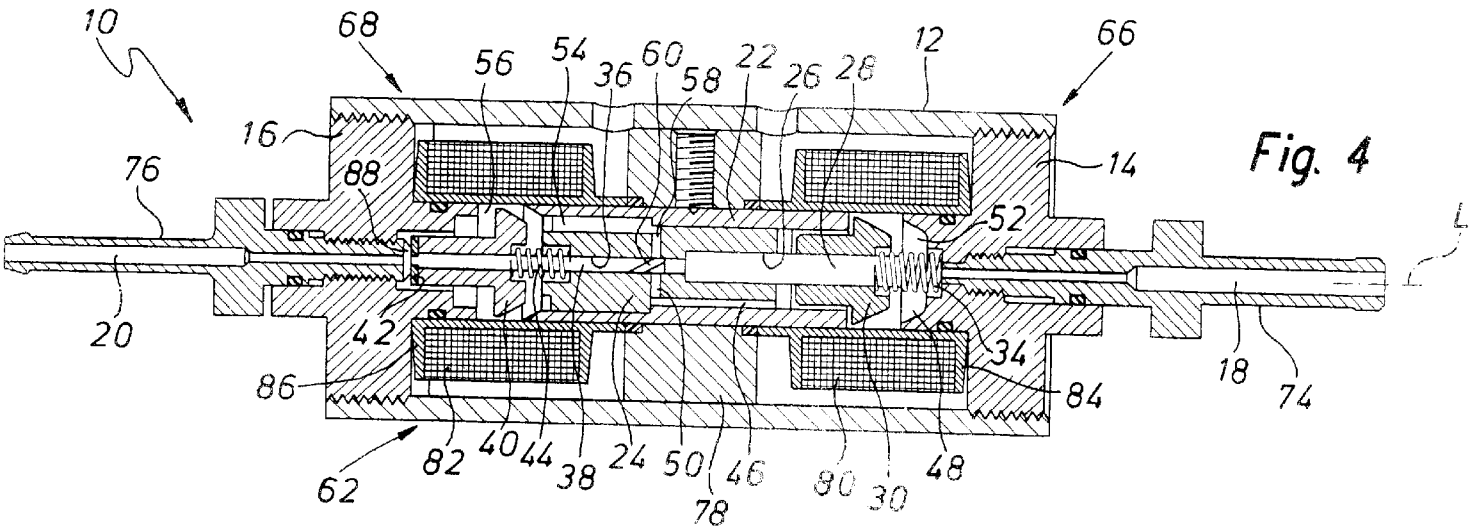
FIG. 4 shows a longitudinal sectional view of an embodiment according to the invention of a metering pump device which is in the already mentioned basic state.
Figure 5:
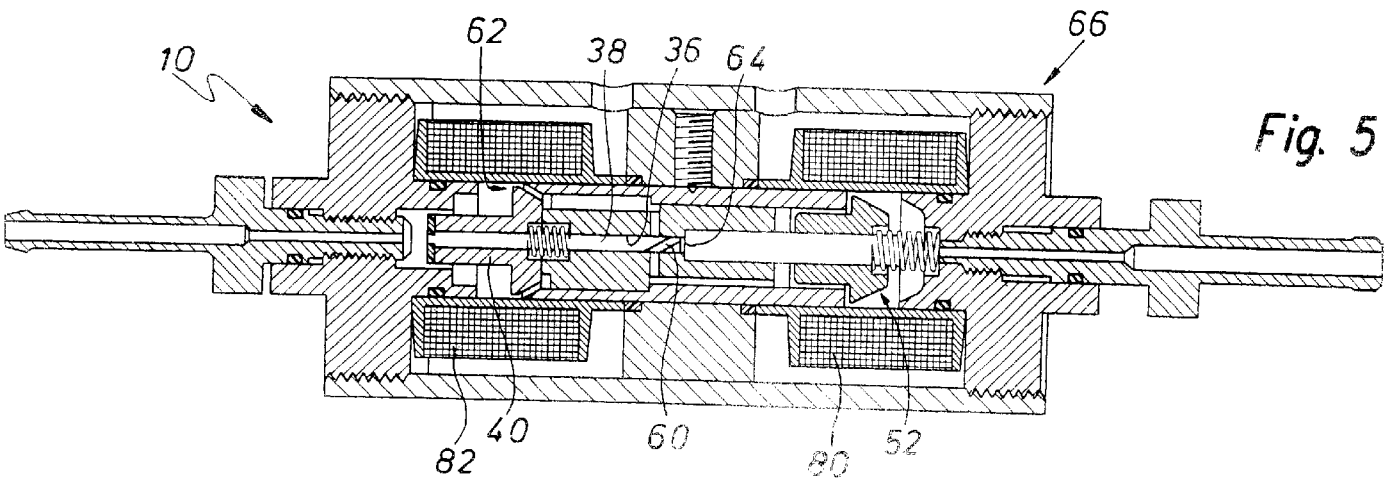
FIG. 5 shows the metering pump device according to FIG. 4 in a state ready to receive liquid.

It can be seen in FIG. 4 that an inlet connection piece 74 or an outlet connection piece 76 is inserted fluid-tightly into the respective end pieces 14, 16, and the inlet aperture 18 or the outlet aperture 20 are now provided in them. Furthermore a support 78 is provided on which the insert member 22 is supported. The magnetic coils 80, 82 are arranged surrounding the insert member 22 and also axial shoulders of the end pieces 14, 16, and are fluid-tightly sealed with respect to the respective end pieces 14, 16 and with respect to the insert member 22 by sealing elements like O-rings. The two magnetic coils 80, 82, or respective substantially annular coil bodies 84, 86, themselves partially bound, in a radially outward direction, the inlet region 52 or the outlet region 62.

It can furthermore be seen that in this embodiment the valve armature 40 is seated on the outlet connection piece 76 and indeed by means of an elastic element 42 which now however only provides the function of a soft stop but no longer a liquid-tight closure in the basic state seen in FIG. 4. Namely, a groove 88 running transversely of the longitudinal midline L is provided in the axial end of the outlet connection piece 76, and the outlet aperture 20 emerges from it, so that also in the basic state visible in FIG. 4, no liquid-tight closure is produced in this region of the valve arrangement 68. On the contrary, in this embodiment, the valve slider 38 alone with its connecting groove 60 serves to differentiate between a delivery state and a closed state.

The different working cycles of this metering pump device 10 can again be seen from FIGS. 4–7. While neither or the magnetic coils 80, 82 is excited in the operating state shown in FIG. 4, and thus the pump piston 28 is pushed to the maximum extent into the pump aperture 26 and the connecting groove 60 closes the inlet region 52 with respect to the pump arrangement 66 by corresponding positioning of the valve slider 38. In the operating state shown in FIG. 5 the valve armature 40 together with the valve slider 38 is pushed toward the right in the drawing, and thus toward the pump arrangement 66, by the excitation of the magnetic coil 82. As a consequence of this, the connecting groove 60 now produces a fluid connection between the end region 64 of the valve aperture 36 and the inlet region 52.

Figure 6:
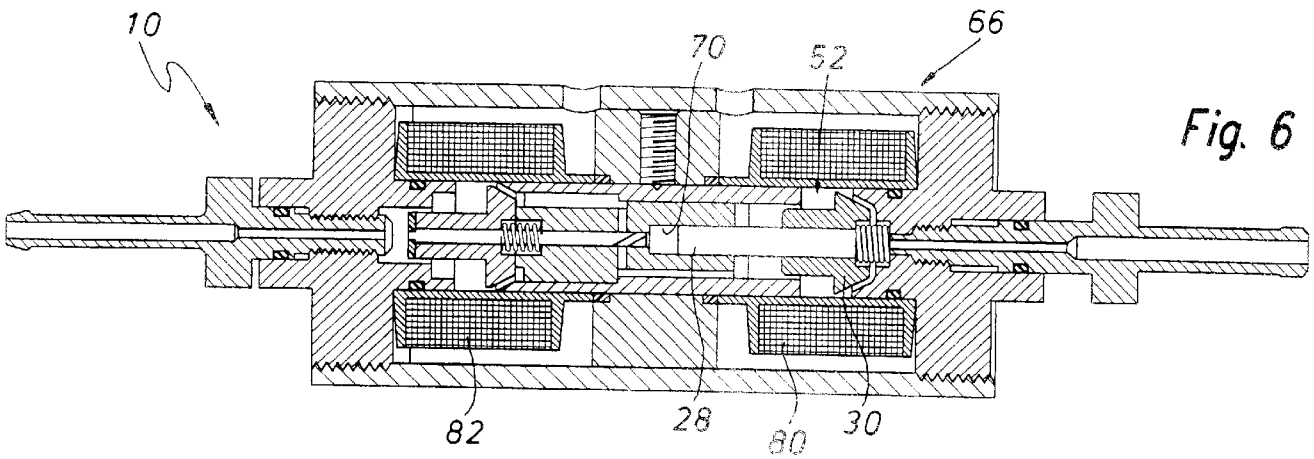
FIG. 6 shows the metering pump device shown in FIG. 4, in a state after receiving liquid.
Figure 7:
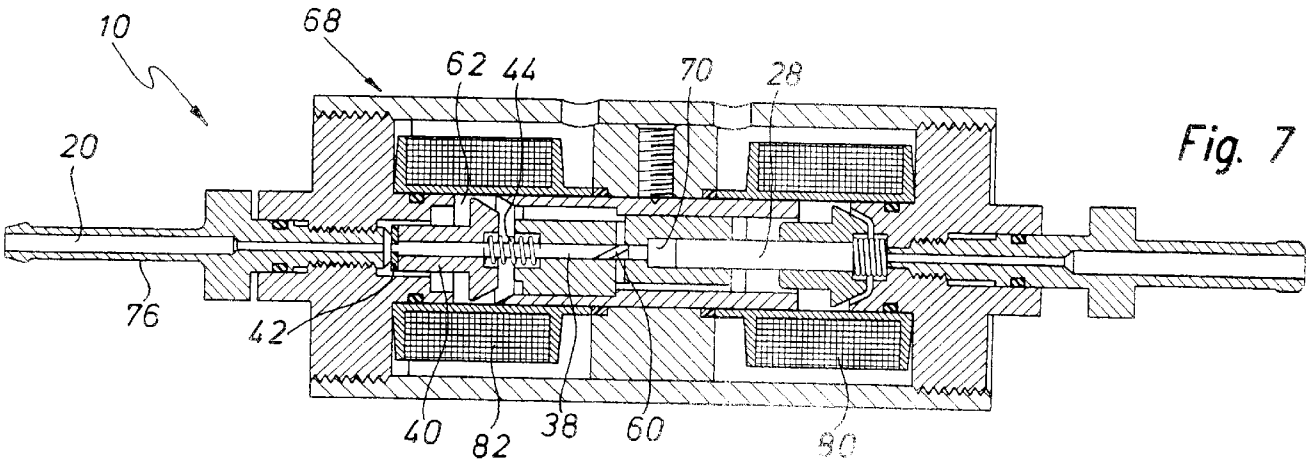
FIG. 7 shows the metering pump device shown in FIG. 4, in a state ready for delivery of liquid.

In the following operating state shown in FIG. 6, the pump armature 30 together with the pump piston 28 is then also displaced by excitation of the magnetic coil 80 of the pump arrangement 66, so that the volume of the pump chamber 70 is now a maximum. In the transition to the operating state seen in FIG. 6, liquid is sucked, or else fed in under pressure, via the inlet region 52 into the pump chamber 70, so that ultimately the whole pump chamber 70 visible in FIG. 6 is filled with the liquid to be delivered. In the following working cycle the excitation of the magnetic coil 82 of the valve arrangement 68 is then canceled. The valve piston 40 together with the valve slide 38 is then displaced again by prestress action of the prestressing spring 44 into the position in which the valve piston 40 is seated by means of the elastic element 42 on the outlet connection piece 76 (FIG. 7). In this state, the connecting grove 60 thus no longer produces a fluid exchange connection between the pump chamber 70 and the inlet region 52. If the current flow through the magnetic coil 80 is also subsequently ended, a transition takes place to the basic state shown in FIG. 4. The pump piston 28 then drives the liquid at first still contained in the pump chamber 70 via the connecting groove 60 into the outlet region 62 and thus through the outlet aperture 20 to a system to be supplied with liquid, for example with fuel.

It can be clearly seen from FIGS. 4–7 that by a flow of current, suitably offset in time, through the magnetic coils 80, 82, the pump arrangement 66 on the one hand and the valve arrangement 68 on the other hand are mechanically decoupled from each other, but the two system regions, effectively coordinated with each other, can be respectively activated at suitable time points, in order on the one hand, as regards the valve arrangement 68, to selectively carry out the changeover of the fluid connection of the pump arrangement with the inlet region 52 or the outlet region 62, or, as regards the pump arrangement 66, selectively with corresponding produced connection to receive liquid to be delivered into the pump chamber 70, or to discharge it again from this.

FIGS. 8–11 show a further embodiment of a metering pump device according to the invention. Components which correspond as regards construction or function to previously described components are denoted by the same reference numerals but with the added letter "a". Only differences from the previous embodiment are discussed in the following.

Figure 8:
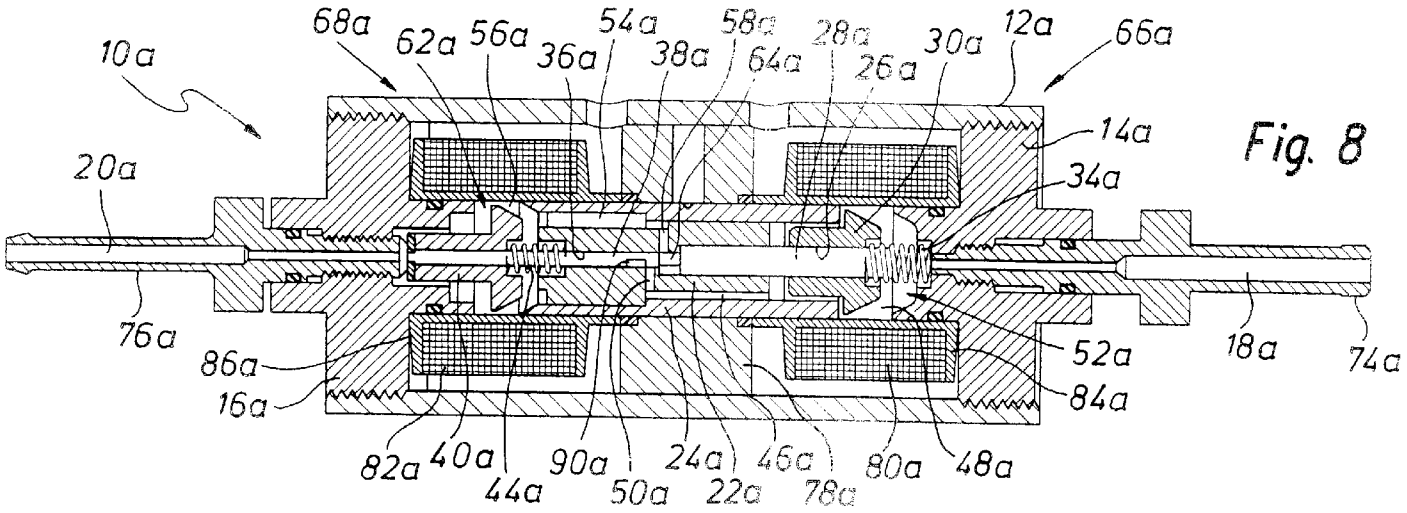
FIG. 8 shows a view corresponding to FIG. 4 of an alternative embodiment of the metering pump device according to the invention.
Figure 9:
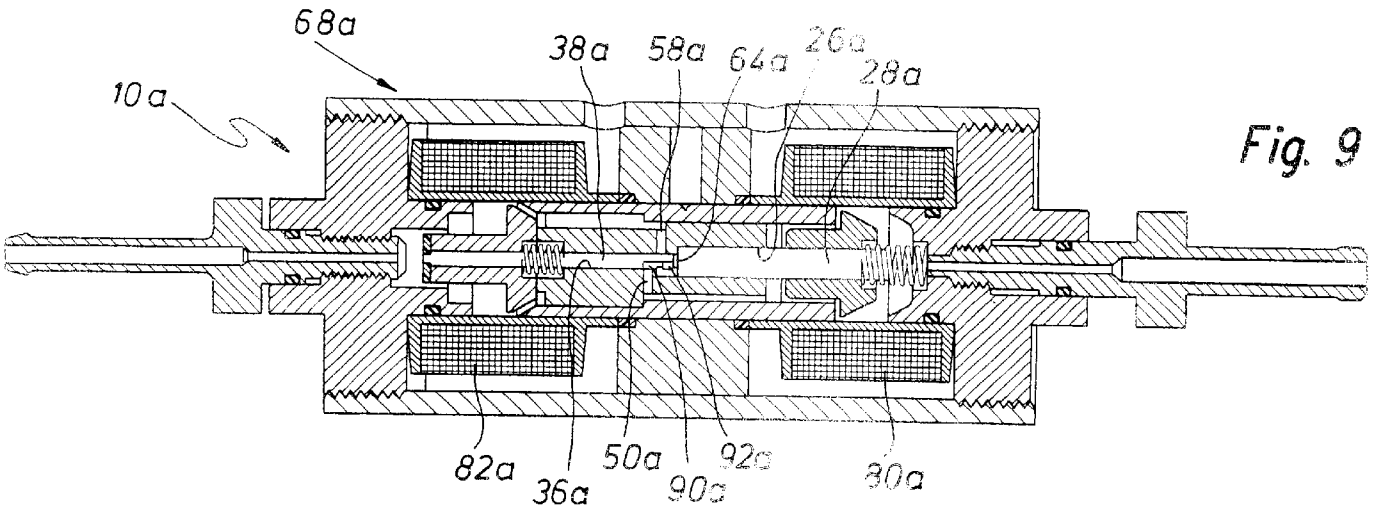
FIG. 9 shows a view corresponding to FIG. 5 of the metering pump device shown in FIG. 8.
Figure 10:
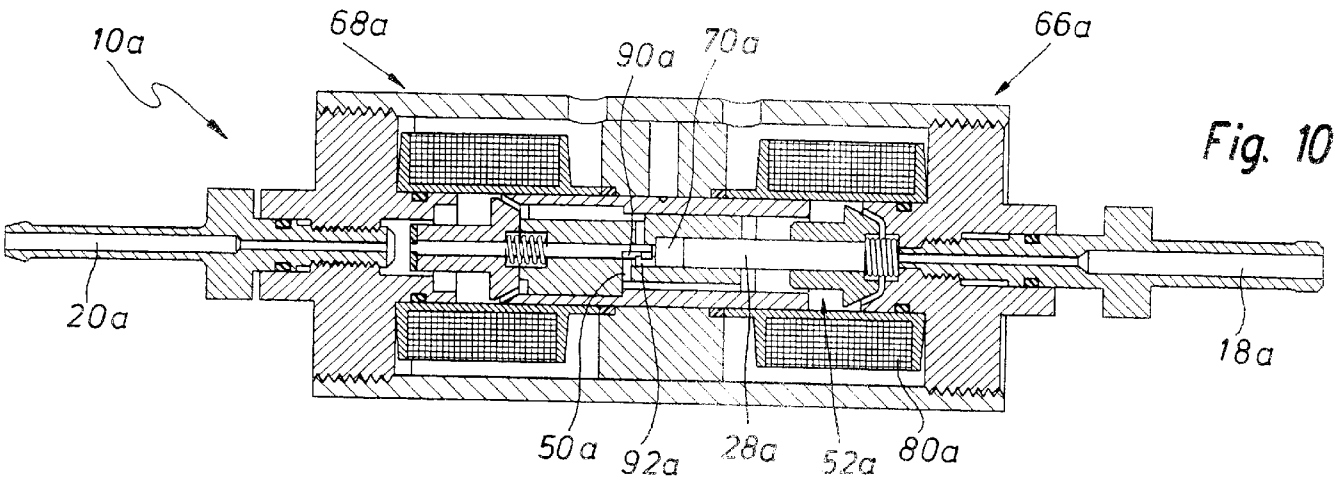
FIG. 10 shows a view corresponding to FIG. 6 of the metering pump device shown in FIG. 8.

A substantial difference of the embodiment shown in FIG. 8 from the embodiment shown in FIG. 4 is that the valve slider 38*a* has no obliquely placed groove in its end region and open both to the outer periphery and also to the axial end face, but has only a connecting recess 90*a* which is open toward the outer peripheral region, and is not open toward the end face of the valve slider 38*a*. In the basic position shown in FIG. 8, in which the valve slider 38*a* is moved away to the maximum extent from the pump piston 28*a*, the valve slider 38*a* projects only so far that the aperture 50*a* is closed by its end region, but that the aperture 58*a* is open to the end region 64*a* of the valve aperture 36*a*. A state is thus again present in which the pump arrangement 66*a* is placed in fluid connection with the outlet region 62*a* by the valve arrangement 68*a*, but the inlet region 52*a* is shut off from the pump arrangement 66*a* by the valve slider 38*a*. On excitation of the magnetic coil 82*a*, the valve arrangement 68*a* is now pushed, as can be seen in FIG. 9, toward the pump piston 28*a* and thus into the end region 64*a* of the valve aperture 36*a*. The valve slider 38*a* now closes the aperture 58*a*, but by means of its connecting recess 90*a* produces a flow connection between the aperture 50*a* and a lateral convexity 92*a*, also open toward the pump aperture 26*a*, in the end region 64*a* of the valve aperture 36*a*. On subsequent excitation of the magnetic coil 80*a* of the pump arrangement 66*a*, the pump piston 28*a* is displaced, as can now be seen in FIG. 10, such that the volume of the pump chamber 70 becomes a maximum, and the inlet region 52*a* is now open to the pump arrangement 66*a* by means of the connection which can be seen in FIG. 10, and liquid can flow into the pump chamber 70*a*.

Figure 11:
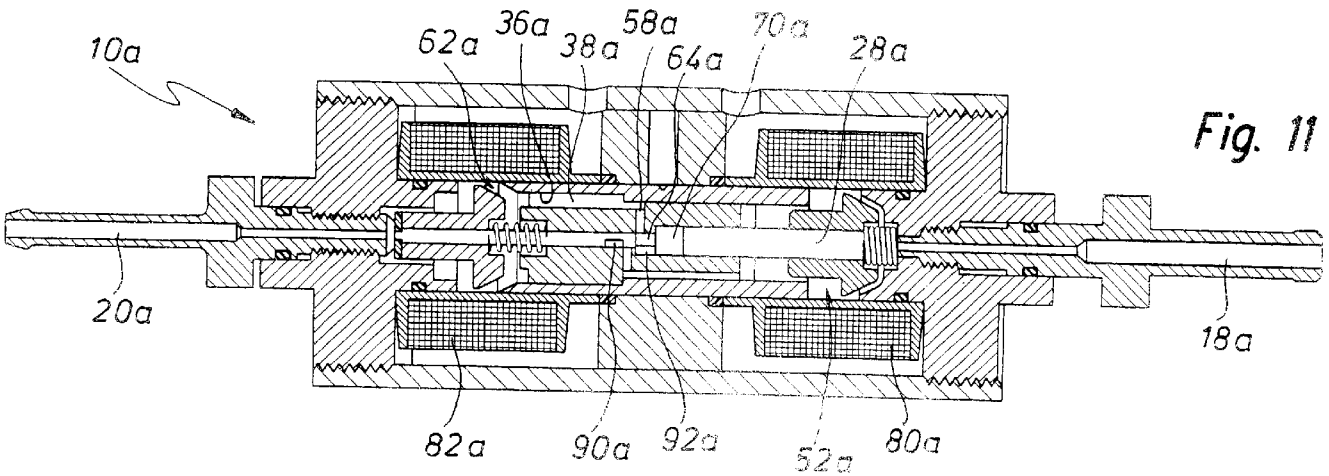
FIG. 11 shows a view corresponding to FIG. 7 of the metering pump device shown in FIG. 8.

Subsequently, upon transition to the state shown in FIG. 11, and thus on transition to a delivery cycle, the current flow of the magnetic coil 82*a* is first canceled, so that a fluid exchange connection between the pump chamber 70*a* and the outlet region 62*a* is produced by the pushing back of the valve slider 38*a*. If then the current flow of the magnetic coil 80*a* is also ended, the pump piston 28*a* returns to the operating position which can be seen in FIG. 8, and pushes the liquid at first still contained in the pump chamber 70*a* via the end region 64*a* of the valve aperture 36*a* and the aperture 58*a* to the outlet aperture 20*a*.

While in the embodiment shown in FIGS. 4–7 a flow path present in the valve slider, substantially formed there by the connecting groove 60, connects the inlet region 52 or the outlet region 62 with the pump arrangement 66 according to the actuating position of the valve slider 38 which forms a valve member, in the embodiment variant shown in FIGS. 8–11 the valve slider is at one time in an actuating position in which it is retracted so far that it does not prevent a fluid flow from the pump arrangement 66*a* to the outlet region 62*a*, but that also no flow takes place via any groove or channel arrangement in the valve slider 38*a*, while in the other actuating position it produces a liquid exchange connection between the inlet region 52*a* and the pump arrangement 66*a* by means of a corresponding flow region on its outer periphery.

A further embodiment of a metering pump device according to the invention is shown in FIGS. 12–23. Components which correspond as regards construction or function to previously described components are denoted by the same reference numerals but with the added letter "b". Also, only functional or constructional differences from the previous embodiments are discussed in the following.

In this embodiment, the valve arrangement 68*b* is equipped with a rotatable valve slider 38*b* for changing over the different flow paths. It can be seen that the valve slider 38*b* has in its free end region an approximately radially extending aperture or bore 100*b*, which opens into an approximately centrally arranged and substantially axially extending blind hole type of aperture or bore 102*b*. The aperture 102*b* is permanently open to the end region 64*b* of the valve aperture 36*b*, and it can be seen here that this end region 64*b* also has, for the production of a fluid-tight closure, a markedly smaller internal dimension than that region of the valve aperture 36*b* in which the valve slider 38*b* is arranged to be rotatable around an axis ultimately corresponding to the longitudinal midline L. It can further be seen that here, for axial centering of the valve slider 38*b*, this is arranged between the pump/valve insert 24*b* and an axial end of the outlet connection piece 76*b*.

Figure 12:
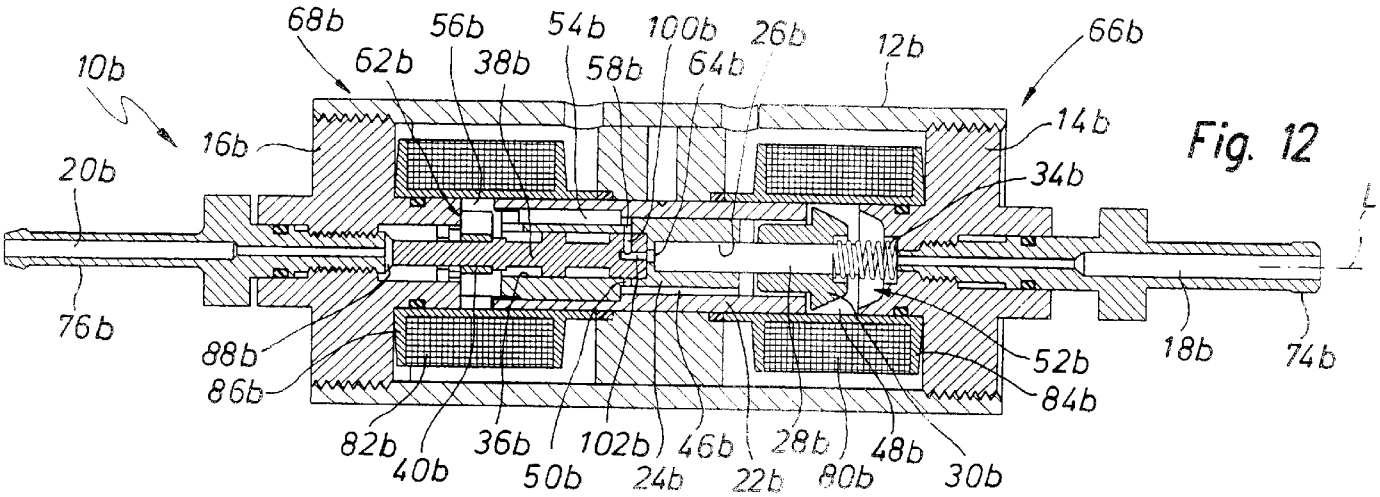
FIG. 12 shows a further view corresponding to FIG. 4 of an alternative embodiment of the metering pump device according to the invention.

In the basic state again shown in FIG. 12, the pump arrangement 66*b*, via the two apertures 100*b*, 102*b*, is again basically in liquid exchange connection with the outlet region 62*b* which is permanently open via the outlet aperture 20*b*. If, as explained in what follows with respect to FIGS. 16–23, the magnetic coil 82*b* allocated to the valve arrangement 68*b* is excited, the valve armature 40*b*, together with the valve slider 38*b* rotationally secured to it, is rotated around the longitudinal midline L, so that ultimately the state is that shown in FIG. 13. In this state, the aperture 100*b* is now aligned with the aperture 50*b* of the inlet region 52*b* provided in the pump/valve insert 24. The inlet region 52*b* is thus again in connection with the pump arrangement 66*b*. The subsequent displacement of the pump piston 28*b* on excitation of the magnetic coil 80*b* of the pump arrangement 66*b* again leads to liquid being able to flow into the then formed pump chamber 70*b* via the inlet region 52*b*.

Figure 15:
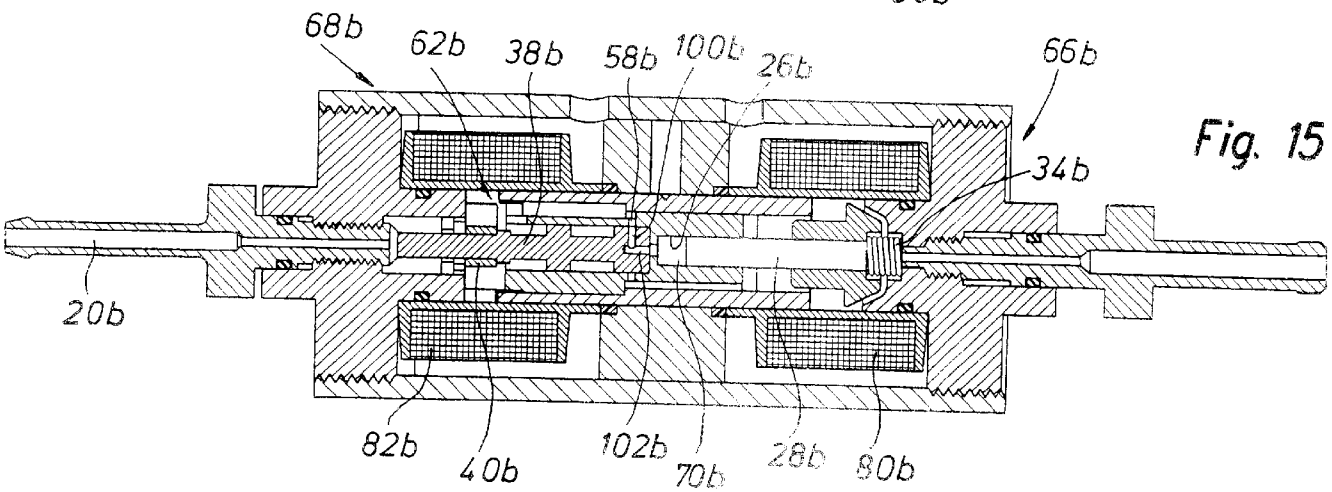
FIG. 15 shows a view corresponding to FIG. 7 of the metering pump device shown in FIG. 12.

In order then to be able to deliver this liquid again to the outlet aperture 20*b*, the excitation of the magnetic coil 82*b* is ended, with the consequence that the valve slider 38*b* is turned further by the action of a further described prestressing spring, and in fact into the actuating position which can be seen in FIG. 15 or also in FIG. 12. In this actuating position, the radially outward projecting aperture 100*b* in the valve slider 38*b* is again in alignment with the aperture 58*b* of the outlet region 62*b*. If current through the magnetic coil 80*b* is then also set on, from the position shown in FIG. 15 the valve piston 28*b* can dip deeper into the pump aperture 26*b* due to the prestress force produced by the prestressing spring 34*b*, and can then deliver the liquid at first still contained in the pump chamber 70*b* via the apertures 102*b*, 100*b* in the valve slider 38*b* to the outlet region 62*b*.

The rotary operation of the valve arrangement 68*b* of this embodiment is described hereinbelow.

Figure 16:
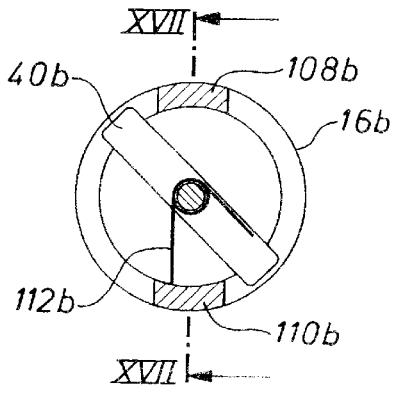
FIG. 16 shows a principle diagram of a valve arrangement such as can be used in the metering pump device according to FIG. 14, sectioned along a line XVI—XVI in FIG. 17.
Figure 17:
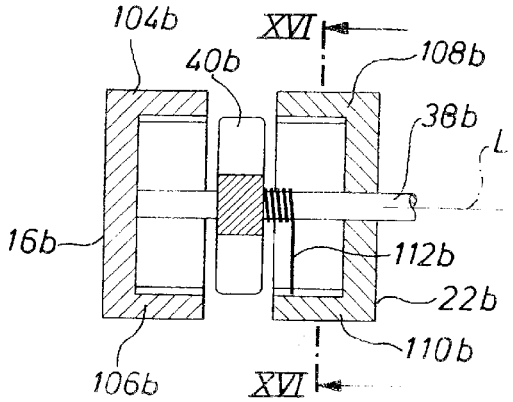
FIG. 17 shows the valve arrangement shown in FIG. 16, sectioned along a line XVII—XVII in FIG. 16.

The valve armature 40*b*, which is substantially of beam-like constitution and is carried, rotationally secured, on the valve slider 38*b*, can be seen from FIGS. 16 and 17, which substantially represent the basic state. The end piece 16*b* and the end region of the insert member 22*b* axially opposed to the end member 16 are furthermore shown schematically. These two components have, in their two mutually facing axial end regions, respective axial projections 104*b*, 106*b* or 108*b*, 110*b* diametrically arranged with respect to the longitudinal midline L. These projections 104*b*, 106*b*, 108*b*, 110*b*, which are axially spaced apart from one another and substantially receive the valve armature 40*b* between them, form respective pole shoes. A torsion spring 112*b* serving as a prestressing spring is supported with one leg on the valve armature 40*b* and its other leg, for example, on the axial projection 110*b* of the insert member 22*b*, and thus prestresses the valve armature 40*b* into the rotated position, which can be seen in FIG. 16, with respect to the opposed pole shoes 104*b*, 106*b*, 108*b*, 110*b*, aligned toward one another in the peripheral direction. A rotation stop is provided here for the valve armature 40*b*. This rotation stop can for example be formed such that, as can be seen in FIG. 12, the valve armature 40*b*, in its end regions extending oppositely from the longitudinal midline L, is constituted with different axial extension, and a rotary motion stop is formed for one of these sections, either at the end piece 16*b* or at the pump/valve insert 24*b* or at the insert member 22*b*, with the interposition of a plastic member.

Figure 18:
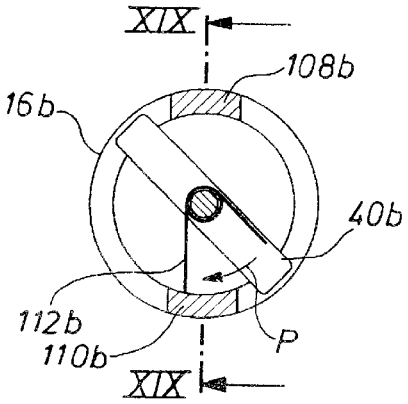
FIG. 18 shows a view corresponding to FIG. 16 of the valve arrangement in a state of production of a magnetic field sectioned along a line XVIII—XVIII in FIG. 19.
Figure 19:
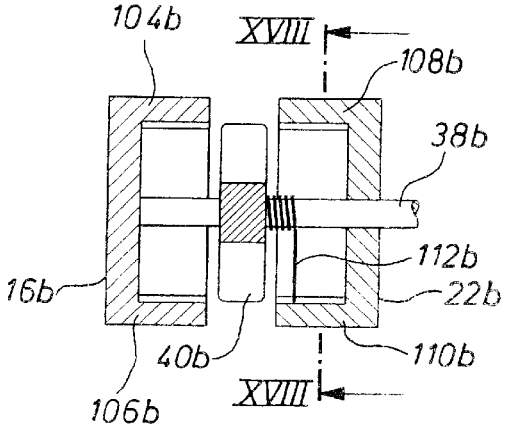
FIG. 19 shows the valve arrangement shown in FIG. 18, sectioned along a line XIX—XIX in FIG. 18.
Figure 20:
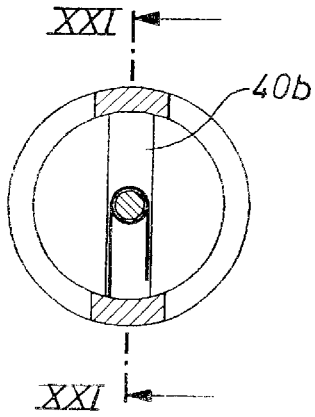
FIG. 20 shows a view corresponding to FIG. 16 in a state after production of a magnetic field and during deflection of a rotary armature, sectioned along a line XX—XX in FIG. 21.
Figure 21:
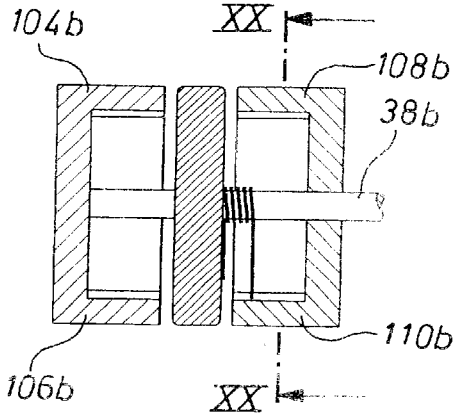
FIG. 21 shows the valve arrangement shown in FIG. 20, sectioned along a line XXI—XXI in FIG. 20.

If the magnetic coil 82*b* is excited, starting from the situation shown in FIGS. 16 and 17, a torque indicated by an arrow P in FIG. 18 is exerted on the valve armature 40*b*, in order to minimize the magnetic resistance or to maximize the magnetic flux. The valve armature 40*b* is rotated by this torque against the prestress of the torsion spring 112*b* so that it assumes in an optimum manner the rotary position which can be seen in FIGS. 20 and 21. In this rotary position, the valve armature, substantially configured like a beam, is with its end regions in alignment with the respective axial projections 104*b*, 106*b*, or 108*b*, 10*b*. The valve slider 38*b* is of course also rotated during this transition.

Figure 13:
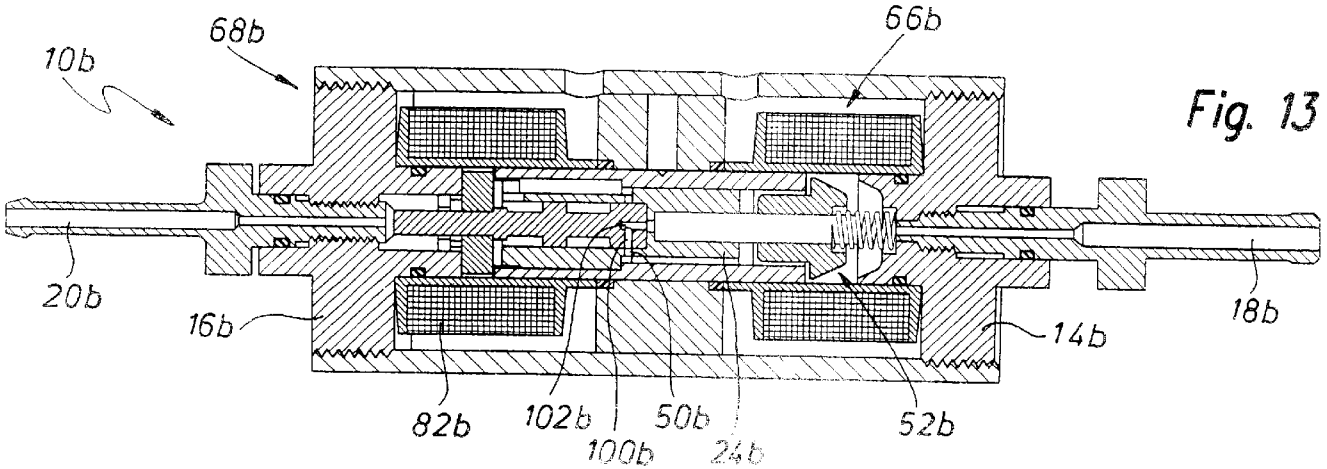
FIG. 13 shows a view corresponding to FIG. 5 of the metering pump device shown in FIG. 12.
Figure 14:
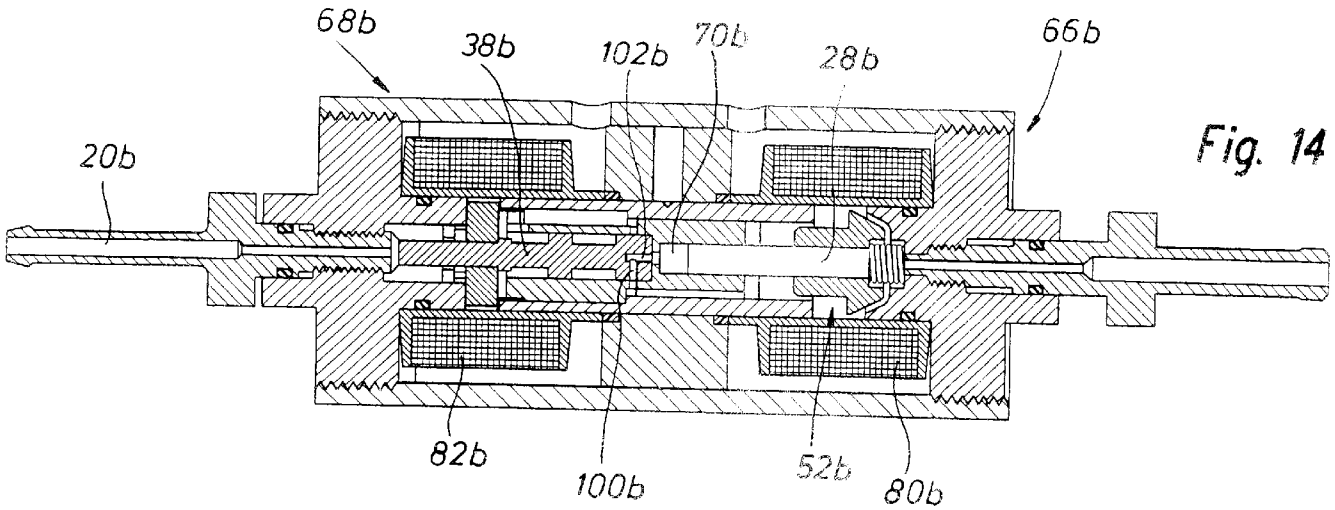
FIG. 14 shows a view corresponding to FIG. 6 of the metering pump device shown in FIG. 12.

It can be recognized that with the schematic illustration or explanation of the rotary function principle, as given using FIGS. 16–21, substantially only a rotation in the angular range of about 45° arises, and not the rotation through 180° required in the transition from the situation shown in FIG. 12 to the situation shown in FIG. 13. Account can however be taken of this in the constructional configuration of the metering pump device 10*b*, in that the two apertures 50*b* and 58*b* are precisely offset from one another in this angular range, in which the valve slider 38*b* is rotated on excitation of the magnetic coil 82*b*. The channel or flow regions adjoining these two apertures 50*b* or 58*b* are of course then also to be positioned correspondingly mutually offset. Alternatively, while retaining the two apertures 50*b*, 58*b* having an angular distance of 180°, it is possible to provide in the valve slider 38*b* two apertures 100*b* opening into the aperture 102*b* which extends substantially axially. These two apertures 100*b* can include an angle in the region of about 135°. If one of these apertures 100*b* is then aligned, for example, with the aperture 50*b*, the other aperture 100*b* has an angular offset of about 45° to the aperture 58*b*. If the valve slider is then rotated by 45°, the other aperture 100*b* can be brought into alignment with the aperture 58*b*. This ultimately means that selectively, by a rotation of the valve slider 38*b* through 45°, the fluid flow path from the inlet region to the pump chamber 70*b* can be released, or the fluid flow path from the pump chamber 70*b* to the outlet region can be released.

Figure 22:
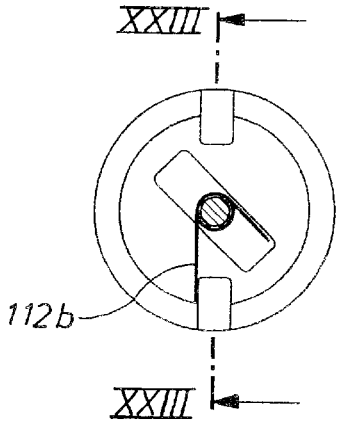
FIG. 22 shows a view of a further embodiment of a valve arrangement with rotatable valve slider in the direction of view XXII in FIG. 23.
Figure 23:
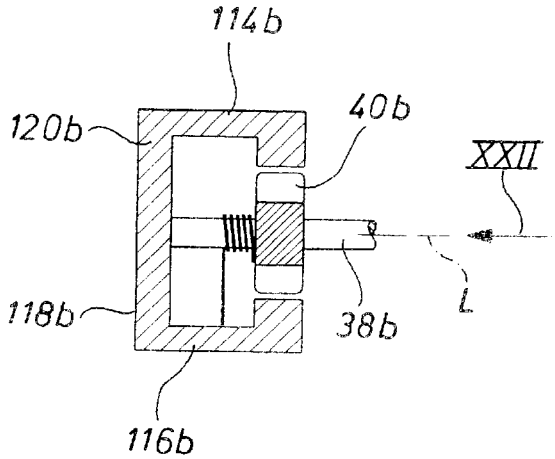
FIG. 23 shows a sectional view of the valve arrangement of FIG. 22, sectioned along a line XXIII—XXIII in FIG. 22.

While in the embodiment variants shown using FIGS. 16–21 the system components also contributing to the formation of the magnetic flux are ultimately all arranged within the magnetic coil 82, a configuration variant is shown in FIGS. 22 and 23 in which a yoke component 118*b* is provided which engages radially outward over the magnetic coil 82 with axial shoulders 114*b*, 116*b*. The armature 40*b* is again situated between the axial end regions of the shoulders 114*b*, 116*b*, and indeed such that in the basic position it is rotated by prestressing of the torsion spring 112*b* around the longitudinal midline L with respect to these two shoulders 114*b*, 116*b*. On excitation of the magnetic coil 82*b*, which could also, for example, be arranged surrounding the section 120*b* connecting the two axial shoulders 114*b*, 116*b*, to minimize the magnetic resistance a torque is again produced by means of which the magnetic armature 40*b*, together with the valve slider 38*b*, is rotated such that it is substantially aligned in the peripheral direction with the two axial shoulders 114*b*, 116*b*.

All the foregoing described embodiments of the metering pump device according to the invention have mechanical independence of the valve arrangement from the pump arrangement. Each of these system regions can thus be constituted of itself. The activation in correct phase of these two regions can be effected by a correspondingly constituted drive device. Since in all the kinds of embodiment the valve arrangement is provided axially immediately adjoining the pump arrangement, and in particular the valve slider is arranged in the direction of movement of, and axially adjoining, the pump piston, the required constructional space can be kept very small. This can be further reinforced when a rotatable valve slider is used, since the axial constructional size can then be still further reduced.

By the mutually independent activatability of the two system regions, valve arrangement and pump arrangement, a mode of operation is furthermore possible which is substantially independent of external influences, such as, for example, temperature, the existing initial pressure of the liquid to be delivered, and the like. This is particularly noticeable when the use is in a motor vehicle in connection with a heating device, such as, e.g., a supplementary heater, since the external conditions fluctuate over a large range in such motor vehicles. The kind of arrangement of a metering pump device can of course also find applications in other regions of application, such as, for example, chemical and process technology, in laboratory work, or in the metering of additives. The construction is in particular comparatively simple because there is no mechanical conformity of movement of the different system regions, since ultimately a conventional piston pump can be used in the pump arrangement, and a construction can be chosen in the region of the valve arrangement which corresponds to the flow-technical construction of a 3/2-way valve.

What is claimed is:

1. A metering pump device comprising:

a pump arrangement (66; 66*a*; 66*b*) for the delivery of liquid which is supplied via an inlet region (52; 52*a*; 52*b*) to an outlet region (62; 62*a*; 62*b*), a valve arrangement (68; 68*a*; 68*b*) by means of which the pump arrangement can be selectively brought into connection with the inlet region (52; 52*a*; 52*b*) to receive liquid, or can be brought into connection with the outlet region (62; 62*a*; 62*b*) for the delivery of liquid, wherein the valve arrangement (68; 68*a*; 68*b*) comprises a valve member (38; 38*a*; 38*b*) that can be brought into a first actuating position and into a second actuating position, wherein in the first actuating position the valve member (38; 38*a*; 38*b*) permits a liquid supply from the inlet region (52; 52*a*; 52*b*) to the pump arrangement (66; 66*a*; 66*b*) and prevents a liquid delivery from the pump arrangement (66; 66*a*; 66*b*) to the outlet region (62; 62*a*; 62*b*), and in the second actuating position the valve member (38; 38*a*; 38*b*) prevents a liquid supply from the inlet region (52; 52*a*; 52*b*) to the pump arrangement (66; 66*a*; 66*b*) and permits a liquid delivery from the pump arrangement (66; 66*a*; 66*b*) to the outlet region (62; 62*a*; 62*b*), further comprising a first actuating force producing arrangement (82; 82*a*; 82*b*) for production of a valve actuating force for the valve member (38; 38*a*; 38*b*) and a second actuating force producing arrangement (80; 80*a*; 80*b*) for production of a pump actuating force for the pump arrangement (66; 66*a*; 66*b*) substantially independently of the production of the valve actuating force, wherein the valve actuating force is substantially in alignment with the pump actuating force.

2. The metering pump device according to claim 1, wherein the pump arrangement (66; 66*a*; 66*b*) comprises a piston (28; 28*a*; 28*b*) displaceable in a pump chamber (70; 70*a*; 70*b*), and the pump chamber (70, 70*a*; 70*b*) can be selectively brought into connection with the inlet region (52; 52*a*; 52*b*) or the outlet region (62; 62*a*; 62*b*) by the valve arrangement (68; 68*a*; 68*b*).

3. The metering pump device according to claim 2, wherein the pump piston (28; 28*a*; 28*b*) is displaceable in a piston displacement direction in the pump chamber (70; 70*a*; 70*b*), and the valve member (38; 38*a*; 38*b*) is arranged following the pump arrangement (66; 66*a*; 66*b*) in the piston displacement direction.

4. The metering pump device according to claim 1, wherein the valve member (38; 38*a*; 38*b*) is displaceable between the first actuating position and the second actuating position.

5. The metering pump device according to claim 1, wherein the valve member (38; 38*a*) has a channel region (60; 90*a*) by means of which the pump arrangement (66; 66*a*) can be brought into liquid exchange connection with at least one of the inlet region (52; 52*a*) and with the outlet region (62; 62*a*).

6. The metering pump device according to claim 1, wherein in the first actuating position or in the second actuating position, the valve member (38*a*) is drawn back out of a position interrupting a flow path between the pump arrangement (66*a*) and the inlet region (52*a*) or the outlet region (62*a*), respectively.

7. The metering pump device according to claim 1, wherein the valve member (38; 38*a*) is slidable for displacement between the first actuating position and the second actuating position.

8. The metering pump device according to claim 1, wherein a liquid intermediate reservoir (72) is in a flow region between the pump arrangement (66) and an outlet aperture (20) of the outlet region (62).

9. The metering pump device according to claim 8, wherein in the second actuating position the outlet aperture (20) of the outlet region (62) is closed by the valve member (38) or by a closure member (42) coupled to the valve member (38) for movement.

10. The metering pump according to claim 1 for a heating device.

11. A metering pump device comprising:

a pump arrangement (66; 66*a*; 66*b*) for the delivery of liquid which is supplied via an inlet region (52; 52*a*; 52*b*) to an outlet region (62; 62*a*; 62*b*), a valve arrangement (68; 68*a*; 68*b*) by means of which the pump arrangement can be selectively brought into connection with the inlet region (52; 52*a*; 52*b*) to receive liquid, or can be brought into connection with the outlet region (62; 62*a*; 62*b*) for the delivery of liquid, wherein the valve arrangement (68; 68*a*; 68*b*) comprises a valve member (38; 38*a*; 38*b*) that can be brought into a first actuating position and into a second actuating position, wherein in the first actuating position the valve member (38; 38*a*; 38*b*) permits a liquid supply from the inlet region (52; 52*a*; 52*b*) to the pump arrangement (66; 66*a*; 66*b*) and prevents a liquid delivery from the pump arrangement (66; 66*a*; 66*b*) to the outlet region (62; 62*a*; 62*b*), and in the second actuating position the valve member (38; 38*a*; 38*b*) prevents a liquid supply from the inlet region (52; 52*a*; 52*b*) to the pump arrangement (66; 66*a*; 66*b*) and permits a liquid delivery from the pump arrangement (66; 66*a*; 66*b*) to the outlet region (62; 62*a*; 62*b*), and further comprising a first actuating force producing arrangement (82; 82*a*; 82*b*) for production of a valve actuating force for the valve member (38; 38*a*; 38*b*) and a second actuating force producing arrangement (80; 80*a*; 80*b*) for production of a pump actuating force for the pump arrangement (66; 66*a*; 66*b*) substantially independently of the production of the valve actuating force, wherein at least one of the first actuating force producing arrangement (82; 82*a*; 82*b*) and the second actuating force producing arrangement (80; 80*a*; 80*b*) is constituted for production of a magnetic force interaction, wherein the valve actuating force is substantially in alignment with the pump actuating force.

12. The metering pump device according to claim 11, wherein the pump arrangement (66; 66*a*; 66*b*) comprises a piston (28; 28*a*; 28*b*) displaceable in a pump chamber (70; 70*a*; 70*b*), and the pump chamber (70, 70*a*; 70*b*) can be selectively brought into connection with the inlet region (52; 52*a*; 52*b*) or the outlet region (62; 62*a*; 62*b*) by the valve arrangement (68; 68*a*; 68*b*).

13. The metering pump device according to claim 12, wherein the pump piston (28; 28*a*; 28*b*) is displaceable in a piston displacement direction in the pump chamber (70; 70*a*; 70*b*), and the valve member (38; 38*a*; 38*b*) is arranged following the pump arrangement (66; 66*a*; 66*b*) in the piston displacement direction.

14. The metering pump device according to claim 11, wherein the valve member (38; 38*a*; 38*b*) is displaceable between the first actuating position and the second actuating position.

15. The metering pump device according to claim 11, wherein the valve member (38; 38*a*) has a channel region (60; 90*a*) by means of which the pump arrangement (66; 66*a*) can be brought into liquid exchange connection with at least one of the inlet region (52; 52*a*) and with the outlet region (62; 62*a*).

16. The metering pump device according to claim 11, wherein in the first actuating position or in the second actuating position, the valve member (38*a*) is drawn back out of a position interrupting a flow path between the pump arrangement (66*a*) and the inlet region (52*a*) or the outlet region (62*a*), respectively.

17. The metering pump device according to claim 11, wherein the valve member (38; 38*a*) is slidable for displacement between the first actuating position and the second actuating position.

18. The metering pump device according to claim 11, wherein a liquid intermediate reservoir (72) is in a flow region between the pump arrangement (66) and an outlet aperture (20) of the outlet region (62).

19. The metering pump device according to claim 18, wherein in the second actuating position the outlet aperture (20) of the outlet region (62) is closed by the valve member (38) or by a closure member (42) coupled to the valve member (38) for movement.

20. The metering pump according to claim 11, for a heating device.

* * * * *